US009629447B1

(12) United States Patent
Martel et al.

(10) Patent No.: US 9,629,447 B1
(45) Date of Patent: Apr. 25, 2017

(54) CELLULAR PHONE TETHERING SYSTEM

(71) Applicants: Cheryl A. Martel, Washington, NH (US); Clement G. Martel, Jr., Washington, NH (US)

(72) Inventors: Cheryl A. Martel, Washington, NH (US); Clement G. Martel, Jr., Washington, NH (US)

( * ) Notice: Subject to any disclaimer, the term of this patent is extended or adjusted under 35 U.S.C. 154(b) by 0 days.

(21) Appl. No.: 14/872,247

(22) Filed: Oct. 1, 2015

(51) Int. Cl.
*A45F 5/00* (2006.01)
*A45F 5/02* (2006.01)

(52) U.S. Cl.
CPC ..... *A45F 5/004* (2013.01); *A45F 5/02* (2013.01)

(58) Field of Classification Search
CPC ..... A45F 5/004
USPC ..... 455/575.1, 575.6
See application file for complete search history.

(56) References Cited

U.S. PATENT DOCUMENTS

| | | | | |
|---|---|---|---|---|
| 5,938,137 | A * | 8/1999 | Poulson | A45F 5/004 242/379.2 |
| 6,502,727 | B1 | 1/2003 | Decoteau | |
| 6,546,103 | B1 | 4/2003 | Wong | |
| 6,550,108 | B2 | 4/2003 | Pratl | |
| D482,521 | S | 11/2003 | Taylor | |
| 8,411,849 | B1 | 4/2013 | McKenzie et al. | |
| 8,509,865 | B1 * | 8/2013 | LaColla | H04M 1/04 455/556.1 |
| 2002/0166212 | A1 * | 11/2002 | Pratl | H04B 1/3833 24/3.2 |
| 2011/0309728 | A1 * | 12/2011 | Diebel | H04B 1/3888 312/293.1 |

* cited by examiner

*Primary Examiner* — Christopher M Brandt

(57) ABSTRACT

A cellular phone tethering system includes a housing that includes a rear wall with a top edge, a bottom edge, a first side edge and a second side edge. An outer wall is attached to and extends along the top edge and at least a portion of each of the first and second side edges. The outer wall extends forward of the rear wall. An inwardly extending lip is attached to and coextensive with an outer edge of the outer wall positioned opposite of the rear wall. The lip is configured to retain a cellular phone in the housing and in abutment with the rear wall. A loop is attached to the housing and a tether is attached to the loop. A reel is attached to the tether and a clip is attached to the reel. The clip is configured to releasably attach the reel to a personal item.

7 Claims, 5 Drawing Sheets

CELLULAR PHONE TETHERING SYSTEM

BACKGROUND OF THE DISCLOSURE

Field of the Disclosure

The disclosure relates to cellular phone retention devices and more particularly pertains to a new cellular phone retention device for attaching a cellular phone to a person or object to prevent losing of the cellular phone.

SUMMARY OF THE DISCLOSURE

An embodiment of the disclosure meets the needs presented above by generally comprising a housing that includes a rear wall with a top edge, a bottom edge, a first side edge and a second side edge. An outer wall is attached to and extends along the top edge and at least a portion of each of the first and second side edges. The outer wall extends forward of the rear wall. An inwardly extending lip is attached to and coextensive with an outer edge of the outer wall positioned opposite of the rear wall. The lip is configured to retain a cellular phone in the housing and in abutment with the rear wall. A loop is attached to the housing and a tether is attached to the loop. A reel is attached to the tether and a clip is attached to the reel. The clip is configured to releasably attach the reel to a personal item.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF THE DRAWINGS

The disclosure will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
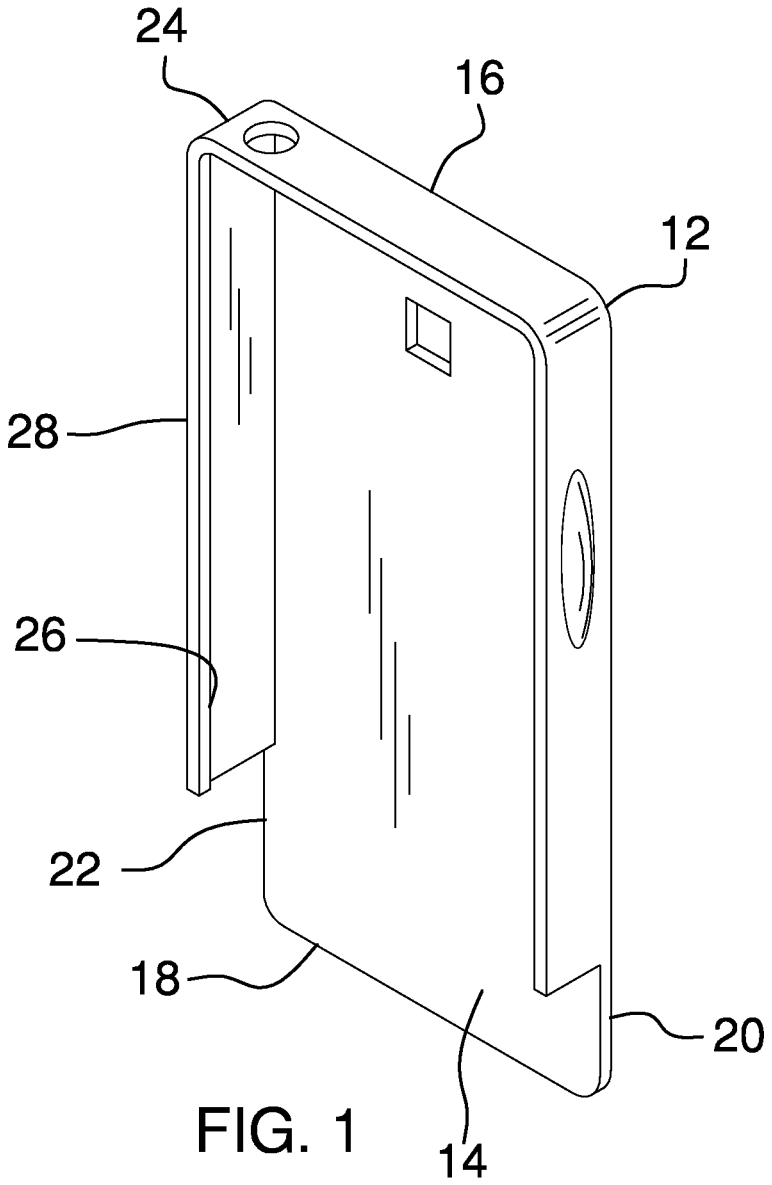
FIG. 1 is a front perspective view of a cellular phone tethering system according to an embodiment of the disclosure.
Figure 2:
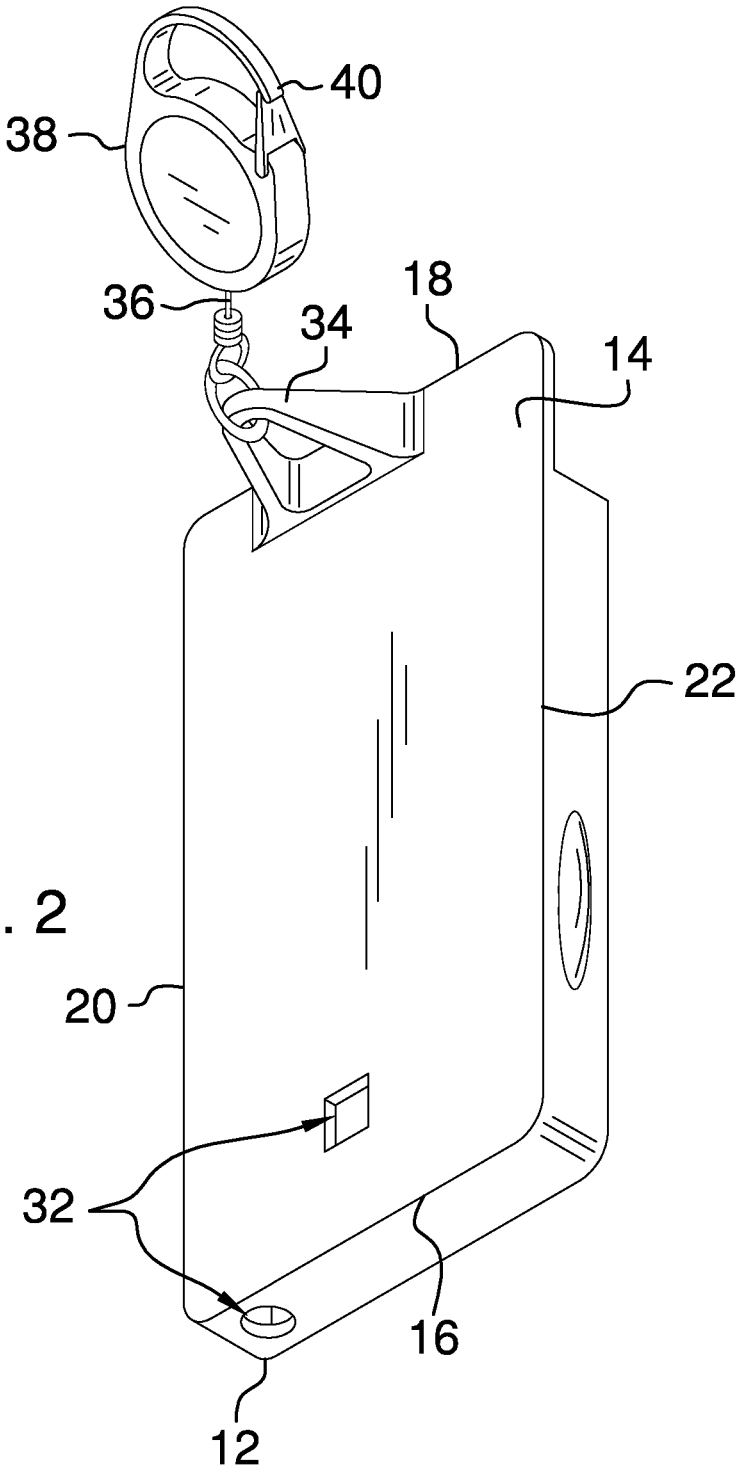
FIG. 2 is a rear perspective view of an embodiment of the disclosure.
Figure 3:
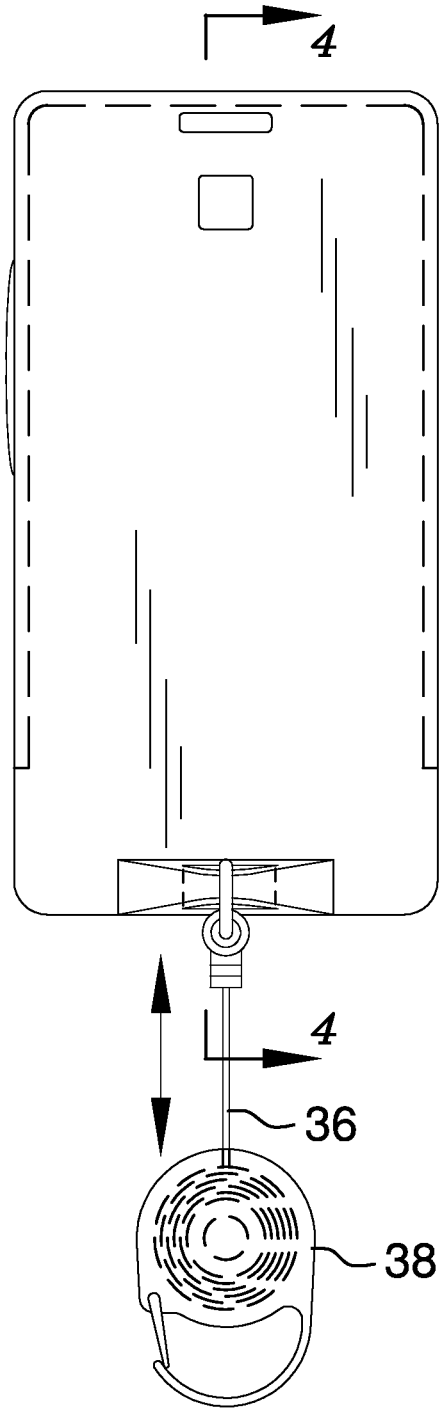
FIG. 3 is a rear view of an embodiment of the disclosure.
Figure 4:
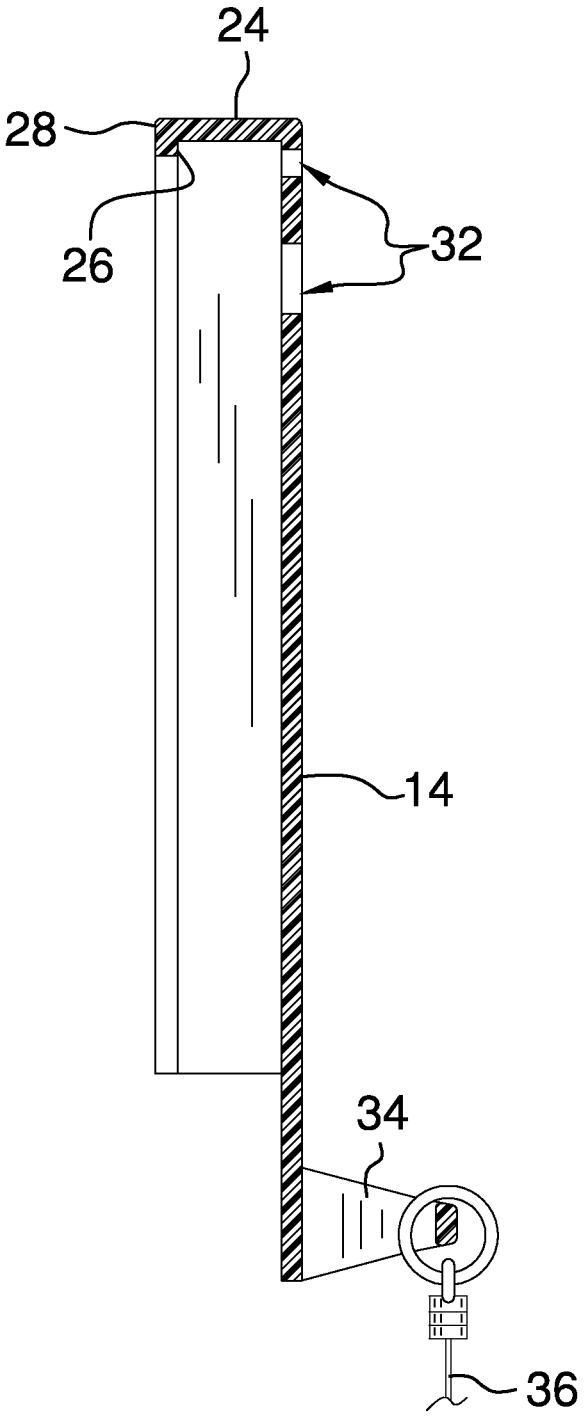
FIG. 4 is a cross-sectional view of an embodiment of the disclosure taken along line 4-4 of FIG. 3.
Figure 5:
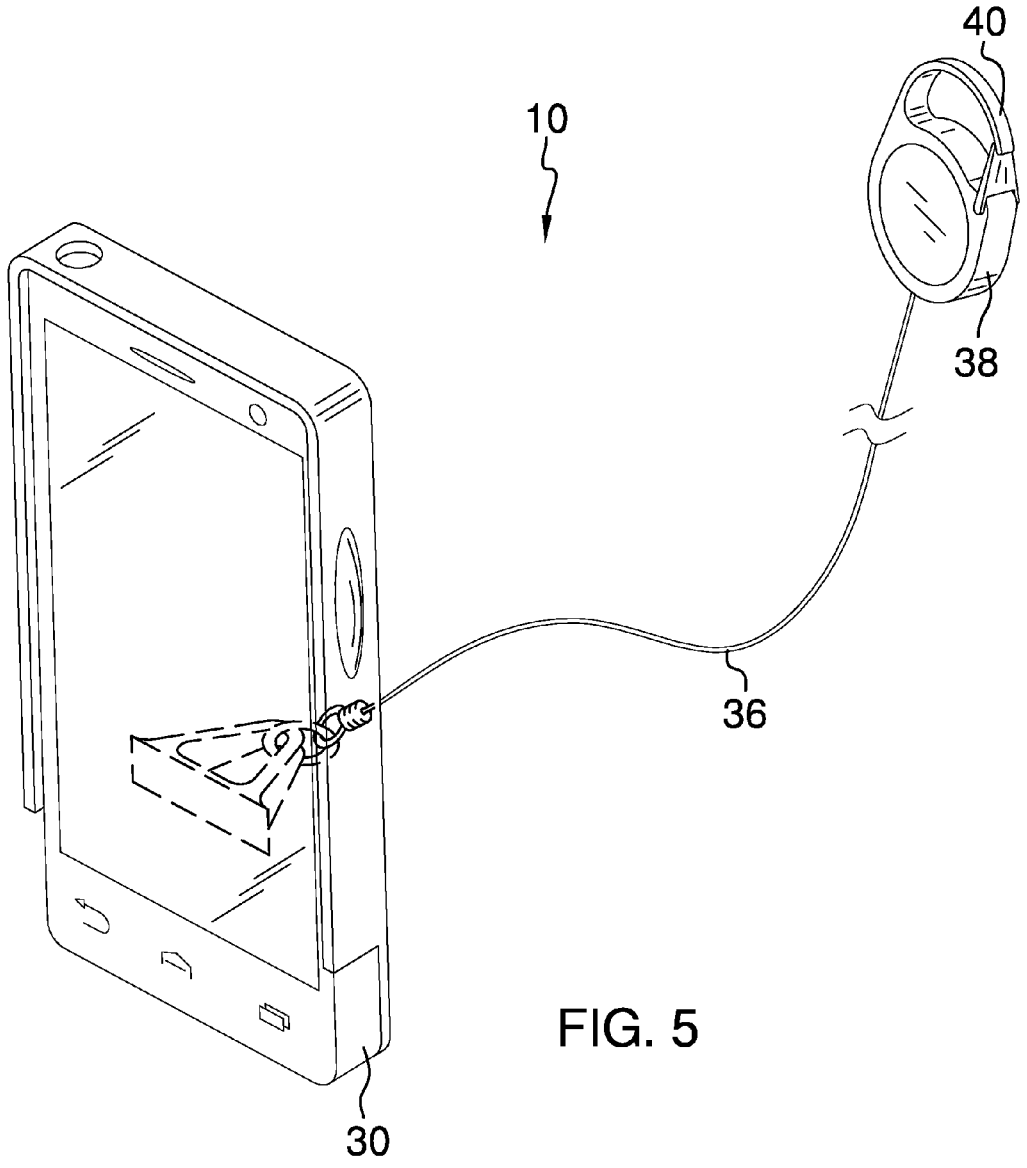
FIG. 5 is a front perspective in-use view of an embodiment of the disclosure.

With reference now to the drawings, and in particular to FIGS. 1 through 5 thereof, a new cellular phone retention device embodying the principles and concepts of an embodiment of the disclosure and generally designated by the reference numeral 10 will be described.

As best illustrated in FIGS. 1 through 5, the cellular phone tethering system 10 generally comprises a housing 12 that includes a rear wall 14 has a top edge 16, a bottom edge 18, a first side edge 20 and a second side edge 22. An outer wall 24 is attached to and extends along the top edge 16 and at least a portion of each of the first 20 and second 22 side edges. As can be seen in the Figures, the outer wall 24 is a partial perimeter wall that may be spaced from the bottom edge 18. The outer wall 24 extends forward of the rear wall 14 and the bottom edge 18 may be open and free of the outer wall 24. An inwardly extending lip 26 is attached to and coextensive with an outer edge 28 of the outer wall 24 positioned opposite of the rear wall 14. The lip 26 is configured to retain a cellular phone 30 in the housing 12 and in abutment with the rear wall 14. The housing 12 has a plurality of apertures 32 extending therethrough to facilitate access to elements of the cellular phone 30. These cellular phone 30 elements may include a camera lens, speaker, audio ports, power ports and the like. The positioning of the apertures 32 will be dependent upon make and model of the cellular phone 30. The housing 12 may be comprised of a plastic or elastomeric material.

A loop 34 is attached to the housing 12. The loop 34 is attached to the rear wall 14 such that the loop 34 extends rearward of the rear wall 14. The loop 34 is positioned adjacent to the bottom edge 18. A tether 36 is attached to the loop 34 and a reel 38 is attached to the tether 36. The tether 36 is extendable outwardly of the reel 38 and may have a length between 12.0 inches and 36.0 inches. The reel 38 automatically retracts the tether 36 back into the reel 38 and this may be accomplished in any conventional manner such as with a spring biased axle to which the tether 36 is attached.

A clip 40 is attached to the reel 38. The clip 40 is used to releasably attach the reel 38 to a personal item. The personal item may be an article of clothing or a personal item which is carried such as a purse, backpack and the like. The system 10 assists a person in not accidentally losing their cellular phone 30 by forgetting it after it has been set down. Additionally, the system 10 will help prevent the cellular phone 30 from being stolen.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

We claim:

1. A cellular phone coupling assembly configured to attach a cellular phone to a person's clothing or another personal item, said assembly comprising:

a housing including a rear wall having a top edge, a bottom edge, a first side edge and a second side edge, an outer wall being attached to and extending along said top edge and at least a portion of each of said first and second side edges and terminating along each of said first and second side edges between said top edge and said bottom edge wherein said bottom edge is open, said outer wall extending forward of said rear wall, an inwardly extending lip being attached to and coextensive with an outer edge of said outer wall positioned opposite of said rear wall, said lip being configured to retain a cellular phone in said housing and in abutment with said rear wall;

a loop being attached to said housing;

a tether being attached to said loop;

a reel being attached to said tether; and a clip being attached to said reel, said clip being configured to releasably attach said reel to a personal item.

2. The cellular phone coupling assembly according to claim 1, wherein said housing has a plurality of apertures extending therethrough to facilitate access to elements of the cellular phone.

3. The cellular phone coupling assembly according to claim 1, wherein said loop is attached to said rear wall.

4. The cellular phone coupling assembly according to claim 3, wherein said loop extends rearward of said rear wall.

5. The cellular phone coupling assembly according to claim 4, wherein said loop is positioned adjacent to said bottom edge.

6. The cellular phone coupling assembly according to claim 1, wherein said reel automatically retracts said tether back into said reel.

7. A cellular phone coupling assembly configured to attach a cellular phone to a person's clothing or another personal item, said assembly comprising:

a housing including a rear wall having a top edge, a bottom edge, a first side edge and a second side edge, an outer wall being attached to and extending along said top edge and at least a portion of each of said first and second side edges and terminating along each of said first and second side edges between said top edge and said bottom edge wherein said bottom edge is open, said outer wall extending forward of said rear wall, an inwardly extending lip being attached to and coextensive with an outer edge of said outer wall positioned opposite of said rear wall, said lip being configured to retain a cellular phone in said housing and in abutment with said rear wall, said housing having a plurality of apertures extending therethrough to facilitate access to elements of the cellular phone;

a loop being attached to said housing, said loop being attached to said rear wall, said loop extending rearward of said rear wall, said loop being positioned adjacent to said bottom edge;

a tether being attached to said loop;

a reel being attached to said tether, said tether being extendable outwardly of said reel, said reel automatically retracting said tether back into said reel; and a clip being attached to said reel, said clip being configured to releasably attach said reel to a personal item.

* * * * *